US007211126B2

(12) United States Patent
Kim et al.

(10) Patent No.: US 7,211,126 B2
(45) Date of Patent: May 1, 2007

(54) METHOD FOR PREPARING NON-MAGNETIC NICKEL POWDERS

(75) Inventors: Soon-ho Kim, Seoul (KR); Jae-young Choi, Gyeonggi-do (KR); Eun-bum Cho, Seoul (KR); Yong-kyun Lee, Gyeonggi-do (KR); Seon-mi Yoon, Daejeon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 364 days.

(21) Appl. No.: 10/854,273

(22) Filed: May 27, 2004

(65) Prior Publication Data

US 2005/0011310 A1 Jan. 20, 2005

(30) Foreign Application Priority Data

May 27, 2003 (KR) ..... 10-2003-0033839

(51) Int. Cl.
*B22F 9/24* (2006.01)

(52) U.S. Cl. ..... 75/348; 75/374

(58) Field of Classification Search ..... 75/398, 75/374

See application file for complete search history.

(56) References Cited

U.S. PATENT DOCUMENTS 5,759,230 A * 6/1998 Chow et al. ..... 75/362
6,974,492 B2 * 12/2005 Harutyunyan et al. ..... 75/351
2006/0090601 A1 * 5/2006 Goia et al. ..... 75/374

FOREIGN PATENT DOCUMENTS

KR 2002-094069 A * 12/2002

OTHER PUBLICATIONS

D.A. Papaconstantopoulos et al., "Ferromagnetism in Hexagonal-Close-Packed Elements", Physical Review B, Feb. 1, 1989, vol. 39 No. 4, pp. 2526-2528.

* cited by examiner

*Primary Examiner*—George Wyszomierski
(74) *Attorney, Agent, or Firm*—Buchanan Ingersoll & Rooney PC

(57) ABSTRACT

Provided is a method for preparing non-magnetic nickel powders. The method include (a) heating a mixture including a nickel precursor compound and a polyol to reduce the nickel precursor compound to nickel powders with a face-centered cubic (FCC) crystal structure, and (b) heating the resultant mixture of step (a) to transform at least a portion of the nickel powders with the FCC crystal structure to nickel powders with a hexagonal close packed (HCP) crystal structure.

21 Claims, 3 Drawing Sheets

METHOD FOR PREPARING NON-MAGNETIC NICKEL POWDERS

BACKGROUND OF THE INVENTION

This application claims priority of Korean Patent Application No. 2003-33839, filed on May 27, 2003, in the Korean Intellectual Property Office, the disclosure of which is incorporated herein by reference in its entirety.

1. Field of the Invention

The present invention relates to nickel powders and a method for preparing the same.

2. Description of the Related Art

Nickel is a transition metal that belongs to the iron group in Period 4, Group VIII of the periodic table and is a crystalline substance with high melting point and excellent malleability.

Nickel powders are a particle-phase metallic nickel material. Nickel powders can be used as, for example, a material for inner electrodes in electronic devices such as multilayer ceramic capacitors (MLCCs), a magnetic material, an electrical contact material, a conductive adhesive material, or a catalyst.

Nickel is known as a representative of ferromagnetic substances. Ferromagnetic substances are those that are strongly magnetized in the direction of a magnetic field applied, and retain magnetization even when the magnetic field is removed.

When a non-magnetized ferromagnetic substance is exposed to an increasing magnetic field, magnetization occurs slowly at an early stage, which is called initial magnetization. Thereafter, the rate of magnetization increases and saturation occurs. When a magnetic field is decreased at a saturation state, magnetization is reduced. However, the reduction course of magnetization is different from the increase course of magnetization. Also, even when a magnetic field becomes zero, magnetization does not reach zero, which is called residual magnetization. When the direction of a magnetic field is reversed and the intensity of the reverse magnetic field is increased, magnetization reaches zero and then the direction of the magnetization is reversed. Thereafter, the reverse magnetization gradually becomes a saturation state. At this time, even when a magnetic field becomes zero, magnetization does not reach zero and reverse residual magnetization remains, thereby creating a closed curve which does not pass through the origin. The closed curve is called a magnetization curve. The magnetization curve is closely related with a magnetic domain structure.

It is known that a ferromagnetic substance has an increased magnetic moment, which is a causative factor of magnetization, produced by parallel electron spins. Also, it is assumed that a ferromagnetic substance has magnetic domains which are clusters of parallel spins. When a magnetic field is applied, magnetic domains are aligned in the direction of the magnetic field. Even when a magnetic field is removed, the orientations of the magnetic domains are maintained for a long time, thereby generating residual magnetization. In this regard, when a temperature of a ferromagnetic substance is raised, the alignment of electron spins in the ferromagnetic substance is randomized by thermal motion. As a result, the ferromagnetic substance loses ferromagnetism and is transformed into a paramagnetic substance. The temperature is called the Curie temperature. The magnitude of a reverse magnetic field necessary to reduce the magnetization of a magnetized magnetic substance to zero is the coercive force.

Magnetic properties of bulk nickel are as follows: about 353° C. of the Curie temperature, about 0.617 T of saturation magnetization, about 0.300 T of residual magnetization, and about 239 A/m of coercive force.

Allotropes of nickel that have been known until now include metallic nickel with a face-centered cubic (FCC) crystal structure and metallic nickel with a hexagonal close packed (HCP) crystal structure.

Almost all common nickel powders are ferromagnetic substances with a FCC crystal structure. There are very rare reports of preparation of nickel powders with a HCP crystal structure. It has been predicted that the nickel powders with a HCP crystal structure are also ferromagnetic substances.

Based on the Stoner theory, D. A. Papaconstantopoulos et al. predicted that HCP nickel must be a ferromagnetic substance [D. A. Papaconstantopoulos, J. L. Fry, N. E. Brener, "Ferromagnetism in hexagonal close packed elements", Physical Review B, Vol. 39, No. 4, 1989. 2. 1, pp 2526–2528].

With respect to preparation of inner electrodes for electronic devices that are representative application areas of nickel powders, conventional ferromagnetic nickel powders have the following disadvantages.

First, when nickel powders contained in pastes for nickel inner electrode formation by a printing method exhibit magnetism, the nickel powders are attracted to each other like magnets and agglomerated, which renders uniform paste formation difficult.

Second, an ultra-high frequency band is used in electronic devices with development of the mobile communication and computer technologies. However, magnetic substances have a high impedance value at such a high frequency band.

These problems can be solved by using non-magnetic nickel powders.

SUMMARY OF THE INVENTION

The present invention provides a method for preparing non-magnetic nickel powders.

According to an aspect of the present invention, there is provided a method for preparing non-magnetic nickel powders, which comprises: (a) heating a mixture comprising a nickel precursor compound and a polyol to reduce the nickel precursor compound to nickel powders with a face-centered cubic (FCC) crystal structure; and (b) heating the resultant mixture of step (a) to transform at least a portion of the nickel powders with the FCC crystal structure to nickel powders with a hexagonal close packed (HCP) crystal structure.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
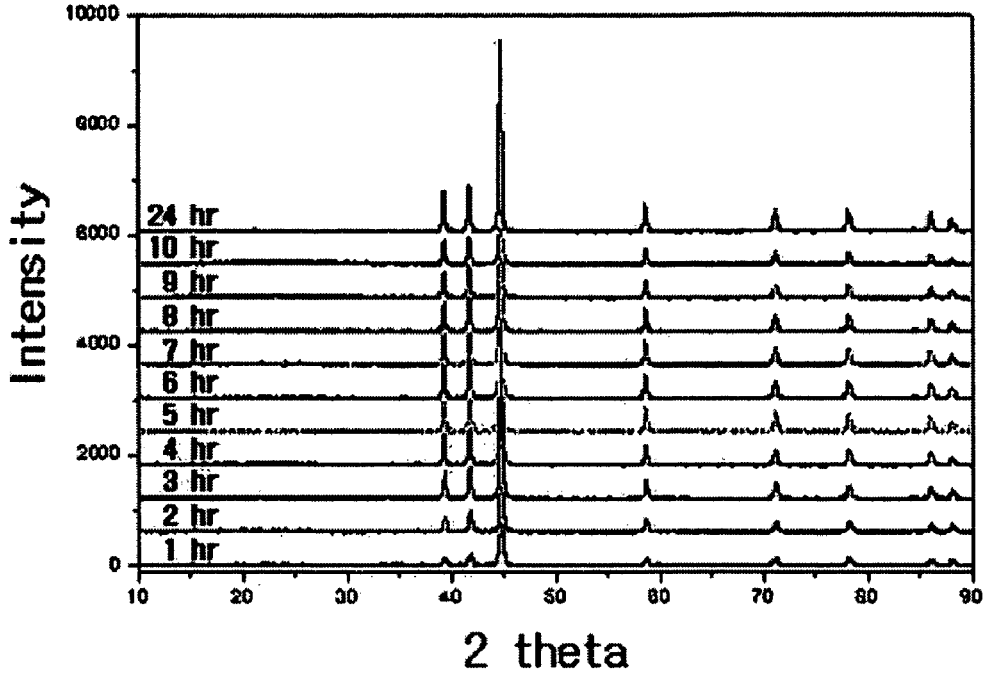
FIG. 1 is an X-ray diffraction (XRD) analysis result for metallic nickel powders according to an example of the present invention.

The present invention provides a method for preparing non-magnetic nickel powders, which include (a) heating a mixture including a nickel precursor compound and a polyol to reduce the nickel precursor compound to nickel powders with a face-centered cubic (FCC) crystal structure and (b) heating the resultant mixture of step (a) to transform at least a portion of the nickel powders with the FCC crystal structure to nickel powders with a hexagonal close packed (HCP) crystal structure.

The present inventor found that when nickel powders of FCC phase, which are common ferromagnetic substances, in a polyol are heated, they are transformed from a FCC crystal structure to a HCP crystal structure, and the nickel powders thus transformed are non-magnetic.

Based on these observations, the present invention was completed by combining a conventional nickel powder preparation method that converts the nickel precursor compound to the FCC nickel powders in the presence of polyol as a reducing agent, with the transformation of the FCC nickel powders in polyol to the HCP nickel powders by heating, in the form of a series of steps. In summary, the present invention provides a method for preparing non-magnetic nickel powders from a nickel precursor compound.

In the above method, the reason for transformation of nickel powders in polyol by heating has not been elucidated, but it seems that metallic nickel dissolved in the polyol is recrystallized or reduced. Even though the exact mechanism of the phase transition has not been elucidated, the effectiveness of the present invention would not be affected.

There are no particular limitations on the nickel precursor compound, provided that it is a nickel-containing compound which can be reduced to metallic nickel by the polyol. The nickel precursor compound includes, for example, nickel oxide (NiO) or nickel salt. Examples of the nickel salt include nickel sulfate, nickel nitrate, nickel chloride, nickel bromide, nickel fluoride, nickel acetate, nickel acetylacetonate, and nickel hydroxide. These nickel precursor compounds may be used alone or in combination.

The polyol serves as a solvent for dissolving the nickel precursor compound. The polyol also serves as a reducing agent for reducing the nickel precursor compound to the metallic nickel. The polyol is an alcoholic compound having two or more hydroxyl groups. Examples of a polyol used as a reducing agent are disclosed in detail in U.S. Pat. No. 4,539,041.

The polyol may be aliphatic glycol, which is a diol, or aliphatic glycol polyester.

Examples of the aliphatic glycol include alkylene glycols with a main chain of $C_2$–$C_6$ such as ethanediol, propanediol, butanediol, pentanediol, and hexanediol, and polyalkylene glycols derived from the alkylene glycols such as polyethylene glycols.

Another examples of the aliphatic glycol include diethylene glycol, triethylene glycol, and dipropylene glycol.

The polyol may also be glycerol which is a triol.

The polyol is not limited to the above-described polyol based compounds. These polyol based compounds may be used alone or in combination.

More preferably, the polyol may be ethyleneglycol, diethyleneglycol, triethyleneglycol, tetraethyleneglycol, propanediol-1,2, propanediol-1,3, dipropyleneglycol, butanediol-1,2, butanediol-1,3, butanediol-1,4, or butanediol-2,3.

An initial content of the polyol in the mixture is not particularly limited and may be appropriately determined considering the solubility of the nickel precursor compound. For example, the mixture may contain the polyol in an amount so that the initial concentration of the nickel precursor compound is in a range of about 0.01 to about 0.5 moles.

To facilitate the reduction of the nickel precursor compound to the metallic nickel, the method of the present invention includes heating the mixture containing the nickel precursor compound and the polyol. Here, the "heating" indicates raising the temperature of the mixture containing the nickel precursor compound and the polyol to a temperature exceeding room temperature, specifically to a temperature exceeding about 20° C.

More preferably, to facilitate the reduction even more, the temperature for the heating may be at least about 45° C.

Generally, as the temperature for the heating increases, the reduction is even more facilitated. However, at more than a certain temperature, the reduction rate may not be increased any more. Furthermore, deterioration of reactants may be caused. In this regard, the temperature for the heating may be about 350° C. or less.

In step (a), the composition of the mixture varies with time. At an early stage, the mixture includes the nickel precursor compound and the polyol. While reduction of the nickel precursor compound to the metallic nickel powders of FCC phase proceeds, the nickel precursor compound and the metallic nickel powders of FCC phase may coexist in the mixture. In the case of using the nickel precursor compound except nickel hydroxide, a portion of the nickel precursor compound may be converted into nickel hydroxide and then reduced to the metallic nickel powders. The remaining of the nickel precursor compound may be directly reduced to the metallic nickel powders without being converted to nickel hydroxide. After a predetermined time, substantially all the nickel precursor compound is reduced to the metallic nickel powders. The duration for the heating may vary depending on the temperature for the heating. Ordinary persons skilled in the art can easily find a reasonable heating duration, and thus, the duration for the heating is not an important factor in implementing the present invention.

After step (a), step (b) in which the metallic nickel powders are transformed from FCC phase to HCP phase is carried out. Step (b) is carried out by heating the mixture that has experienced step (a).

In step (b), if the heating temperature for the mixture is too low, the phase transition from FCC to HCP may be retarded. Even if the heating temperature is too high, the phase transition rate may not be increased any more. Also, the polyol used may be thermally decomposed. In this regard, the heating temperature for step (b) may be in a range of about 150 to about 380° C.

In an embodiment of the present invention that uses an airtight reaction vessel provided with a reflux cooling apparatus, it is preferable to set the heating temperature for step (b) to near the boiling point of the polyol. If the heating temperature is excessively lower than the boiling point of the polyol, phase transition may not be completed. On the other hand, if it is excessively higher than the boiling point of the polyol, a troublesome that a reaction vessel resistant to high pressure must be used may be caused. In this regard, it is preferable to set the heating temperature for step (b) to a range of the boiling point of the polyol ±5° C. More preferably, the mixture of step (b) may be heated so that the polyol of the mixture boils.

In the step (b), if the time for heating the mixture for phase transition is too short, the nickel powders' phase transition from FCC to HCP may not occur. If the time is too long, the agglomeration of nickel particles may occur, and an unnecessary heating may keep going even after the completion of the phase transition. In this regard, the time for the mixture heating for phase transition in the step (b) may be about 10 minutes to about 24 hours. Also, the phase transition may be continued for a sufficient time so that substantially all of the nickel powders of FCC phase are transformed to the nickel powders of HCP phase. The phase transition time according to concrete reaction conditions can be easily determined.

When the phase transition is completed, the nickel powders of HCP phase are separated from the mixture by washing and drying that are generally used in preparation of nickel powders. The nickel powders of HCP phase prepared according to the method of the present invention have non-magnetic property. Typically, the nickel powders prepared by the present invention may contain at least about 1 wt % of HCP nickel powders.

According to another embodiment of the present invention, the mixture of step (a) may further include an organic base, an inorganic base, or a mixture thereof. As known experimentally, the nickel precursor compound is most easily reduced to the metallic nickel at a pH of about 9 to 11. The organic base mainly serves to adjust the pH of the mixture to an appropriate value.

The inorganic base may be hydroxide of an alkaline metal such as NaOH and KOH.

Examples of the organic base include tetramethylammonium hydroxide (TMAH), tetraethylammonium hydroxide (TEAH), tetrabutylammonium hydroxide (TBAH), tetrapropylammonium hydroxide (TPAH), benzyltrimethylammonium hydroxide, dimethyldiethylammonium hydroxide, ethyltrimethylammonium hydroxide, tetrabutylphosphonium hydroxide, trimethylamine (TMA), diethylamine (DEA), and ethanolamine, which can be used alone or in combination.

There are no particular limitations on the content of the base in the mixture. By way of example, the mixture may contain the base in an amount so that an initial pH of the mixture is preferably about 9 or more, more preferably about 10 or more. As a more illustrative example, an initial content of the base in the mixture may be in a range of about 1 to 10 moles, based on 1 mole of the nickel precursor compound.

According to another embodiment of the present invention, the mixture of step (a) may further include a nucleation agent. The nucleation agent serves to allow the metallic nickel powders precipitated after reduction to have more uniform particle sizes. The nucleation agent may be $K_2PtCl_4$, $H_2PtCl_6$, $PdCl_2$, or $AgNO_3$. There are no particular limitations on the content of the nucleation agent in the mixture. For example, the content of the nucleation agent in the mixture may be in a range of about 1/10,000 to 2/1,000 moles, based on 1 mole of the nickel precursor compound. Generally, the content of the nucleation agent in the mixture may be about 0.1% of the nickel precursor compound.

Hereinafter, the present invention will be described more specifically by Examples. However, the following Examples are provided only for illustrations and thus the present invention is not limited to or by them.

EXAMPLES

Example 1

TEG+TMAH 90.6 g of tetramethylammonium hydroxide (TMAH) was dissolved in 250 ml of triethylene glycol (TEG) to prepare a first solution. 40 g of $Ni(CH_3COO)_2 \cdot 4H_2O$ was dissolved in 250 ml of TEG to prepare a second solution. 0.0664 g of $K_2PtCl_4$, which is a nucleation agent, was dissolved in 2 ml of ethylene glycol to prepare a third solution. The first solution, the second solution, and the third solution were placed into a reactor provided with a reflux cooler and then stirred.

The resultant mixture in the reactor was heated using a heating mantle equipped with a magnetic stirrer at 190° C. for 10 minutes to produce FCC metallic nickel powders. At this time, a sample of the produced FCC metallic nickel powders was centrifuged and then washed with ethanol. The sample of the FCC metallic nickel powders thus obtained was dried in a vacuum oven at 25° C. overnight. Then, the saturation magnetization of the FCC sample was measured with MODEL4VSM 30 kOe (DMS Corp.), and the result was 24.0 emu/g.

Subsequently, the mixture in the same reactor was heated at 220° C., and samples of nickel powders were taken as time goes by. The samples of the nickel powders was centrifuged and then washed with ethanol. The samples of the nickel powders thus obtained were dried in a vacuum oven at 25° C. overnight. X-ray diffraction (XRD) analyses of the samples were performed at angles of 10° to 90° by using X'PERT-MPD System (Philips corp.), and the results with time are shown in FIG. 1. As can be seen in FIG. 1, all of the samples taken at 1 to 24 hours-elapsed points are transferred to the HCP phase. And, the saturation magnetization of each sample was measured, and the results are 0.030 emu/g (at 1 hour lapse), 0.028 emu/g (at 2 hours lapse), 0.027 emu/g (at 3 hours lapse), 0.020 emu/g (at 4 hours lapse), 0.019 emu/g (at 5 hours lapse), 0.019 emu/g (at 6 hours lapse), 0.018 emu/g (at 7 hours lapse), 0.018 emu/g (at 8 hours lapse), 0.019 emu/g (at 9 hours lapse), 0.018 emu/g (at 10 hours lapse), 0.018 emu/g (at 24 hours lapse). That is, while the phase of nickel powders is transferred from FCC to HCP, the saturation magnetization of the nickel powders is reduced to about 1/1200 of FCC. The particles of the FCC and HCP nickel powders prepared from Example 1 had an average particle size of about 180 nm and a shape of sphere.

Example 2

DEG+TMAH 90.6 g of TMAH was dissolved in 250 ml of diethylene glycol (DEG) to prepare a first solution. 30 g of $Ni(CH_3COO)_2 \cdot 4H_2O$ was dissolved in 250 ml of DEG to prepare a second solution. 0.0249 g of $K_2PtCl_4$, which is a nucleation agent, was dissolved in 2 ml of ethylene glycol to prepare a third solution. The first solution, the second solution, and the third solution were placed into a reactor provided with a reflux cooler and then stirred.

The resultant mixture in the reactor was heated using a heating mantle equipped with a magnetic stirrer at 190° C.

for 40 minutes to produce FCC metallic nickel powders. The produced FCC metallic nickel powders were centrifuged and then washed with ethanol. The FCC metallic nickel powders thus obtained were dried in a vacuum oven at 25° C. overnight. The saturation magnetization of the FCC nickel powders was 24.2 emu/g.

Figure 2:
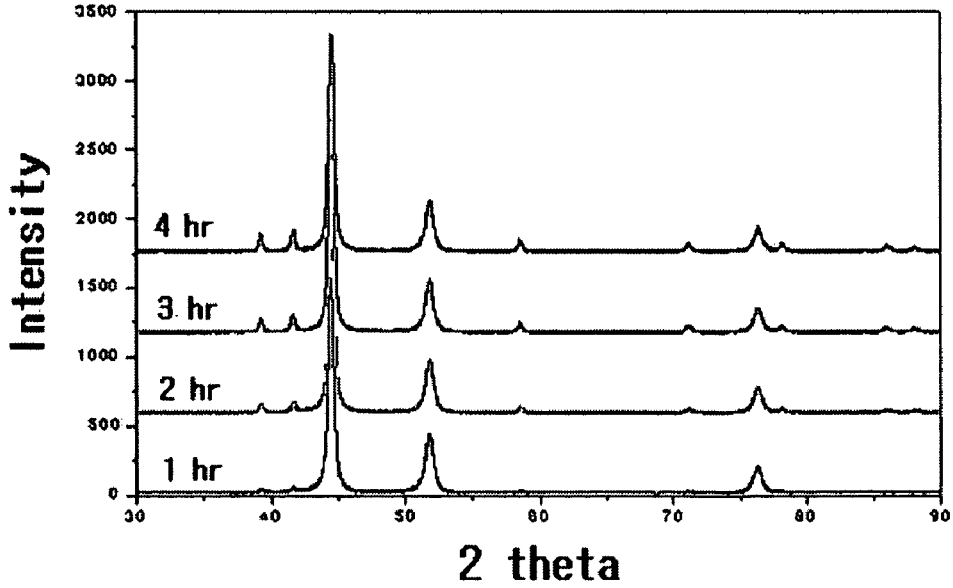
FIG. 2 is an X-ray diffraction (XRD) analysis result of metallic nickel powders according to another example of the present invention.

Subsequently, the mixture in the same reactor was heated at 220° C., and samples of nickel powders were taken as time goes by. The samples of the nickel powders was centrifuged and then washed with ethanol. The samples of the nickel powders thus obtained were dried in a vacuum oven at 25° C. overnight. Then, X-ray diffraction (XRD) analyses of the samples were performed at angles of 10° to 90°, and the results with time are shown in FIG. 2. The HCP fractions of the samples were 10 wt % (at 1 hour lapse), 18 wt % (at 2 hours lapse), 29 wt % (at 3 hours lapse), and 35 wt % (at 4 hours lapse). The saturation magnetization values of the samples were 23.4 emu/g (at 1 hour lapse), 22.8 emu/g (at 2 hours lapse), 21.7 emu/g (at 3 hours lapse), and 21.0 emu/g (at 4 hours lapse). These values are lower than the saturation magnetization value of the above FCC nickel powders (24.2 emu/g). The particles of the FCC and HCP nickel powders prepared from Example 2 had an average particle size of about 220 nm and a shape of sphere.

Example 3

DEG+NaOH

A mixture containing 10 g of 2.5M NaOH aqueous solution, 0.054 g of $K_2PtCl_4$, 500 ml of diethylene glycol, and 30 g of $Ni(CH_3COO)_2 \cdot 4H_2O$ was placed into a reactor provided with a reflux cooler and then stirred.

The mixture in the reactor was heated at 190° C. for 30 minutes to produce FCC metallic nickel powders. Subsequently, the mixture in the same reactor was heated at 190° C. for 24 hours to effect the phase transition of the nickel powders. Then, the nickel powders were centrifuged and washed with ethanol. The nickel powders thus obtained were dried in a vacuum oven at 25° C. overnight.

Figure 3:
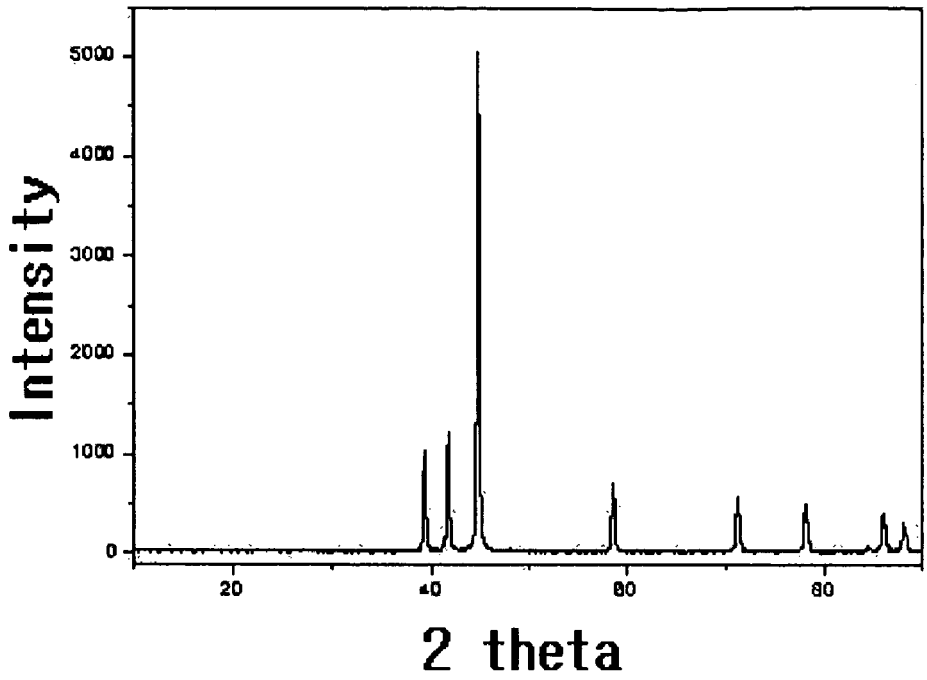
FIG. 3 is an XRD analysis result for metallic nickel powders according to another example of the present invention.

Then, X-ray diffraction (XRD) analysis of thus obtained nickel powders was performed, and the results is shown in FIG. 3. The HCP fraction of the nickel powders was 100 wt %. The saturation magnetization of the nickel powders was 0.03 emu/g. The observation by SEM showed that the particles of the nickel powders had an average particle size of about 120 nm and a shape of semi-sphere.

Example 4

EG

A mixture containing 0.054 g of $K_2PtCl_4$, 500 ml of ethylene glycol, and 30 g of $Ni(CH_3COO)_2 \cdot 4H_2O$ was placed into a reactor provided with a reflux cooler and then stirred.

Figure 4:
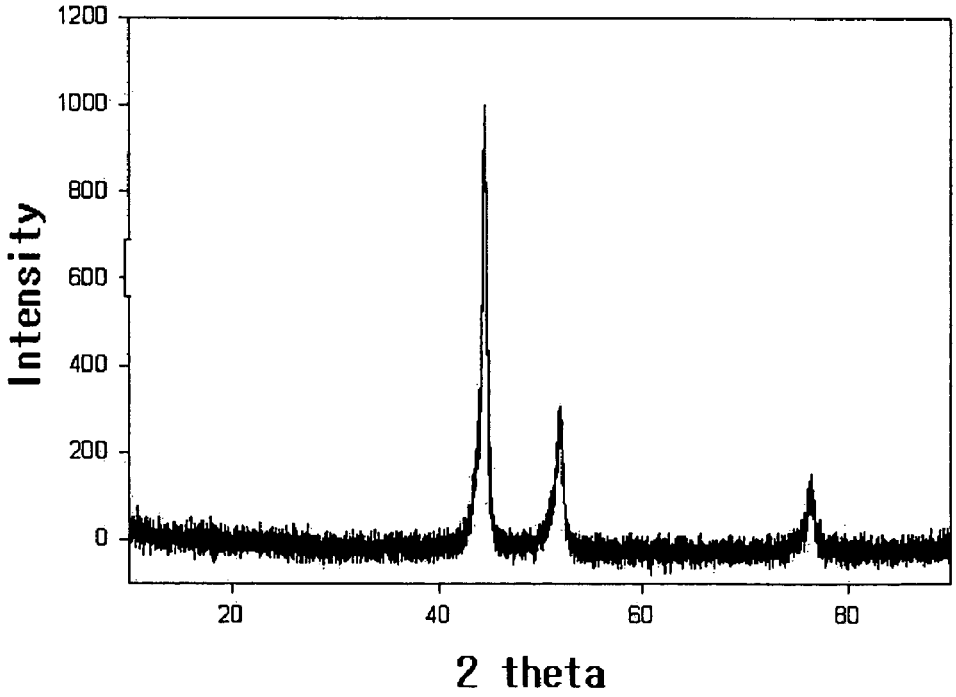
FIG. 4 is an XRD analysis result for FCC metallic nickel powders which are an intermediate from another example of the present invention.

The mixture in the reactor was heated at 190° C. for 1 hour to produce FCC metallic nickel powders. The XRD analysis result for this FCC nickel powders is shown in FIG. 4. The FCC fraction of the nickel powders was 100 wt %. The saturation magnetization of the FCC nickel powders was 24.5 emu/g.

Subsequently, the mixture in the same reactor was heated at 190° C. for 24 hours to effect the phase transition of the nickel powders. Then, the nickel powders were centrifuged and washed with ethanol. The nickel powders thus obtained were dried in a vacuum oven at 25° C. overnight.

Figure 5:
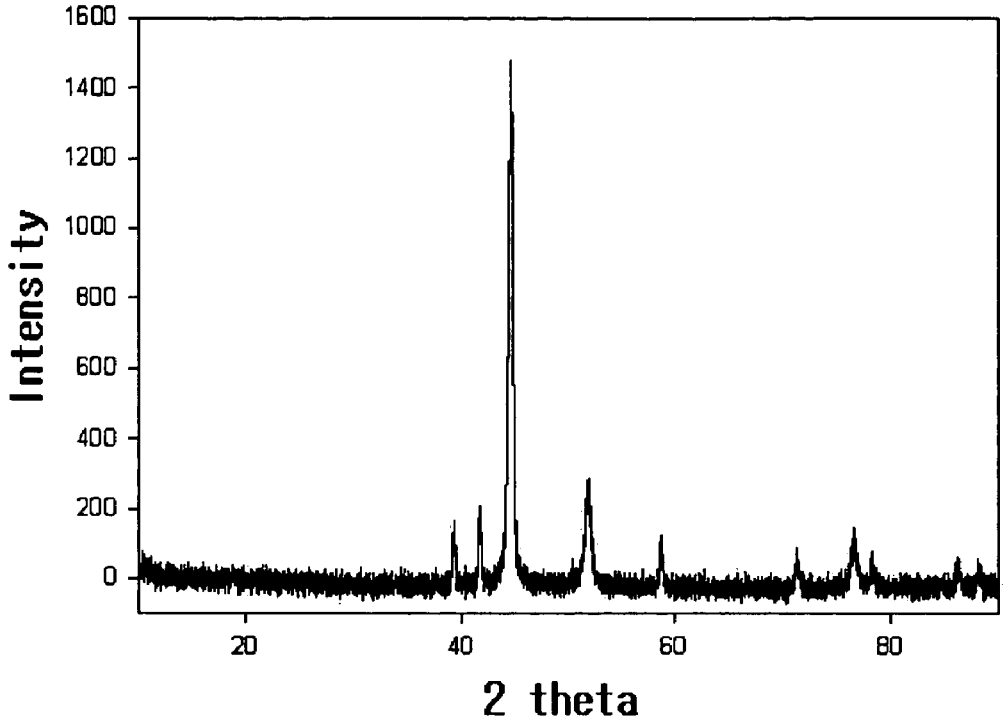
FIG. 5 is an XRD analysis result for HCP-containing metallic nickel powders which are a final product from the example of FIG. 4.

Then, X-ray diffraction (XRD) analysis of thus obtained nickel powders was performed, and the results is shown in FIG. 5. The HCP fraction of the nickel powders was 55 wt %. The saturation magnetization of the nickel powders was 18.5 emu/g. The observation by SEM showed that the particles of the nickel powders had an average particle size of about 120 nm and a shape of semi-sphere.

As apparent from the above descriptions, according to a method of the present invention, non-magnetic nickel powders with a HCP crystal structure can be easily prepared.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method for preparing nickel powder having a reduced saturation magnetization of no more than 18.5 emu/g, comprising:

(a) heating a mixture comprising a nickel precursor compound and a polyol to reduce the nickel precursor compound to metallic nickel powder with a face-centered cubic (FCC) crystal structure; and thereafter (b) heating the resultant mixture of step (a) to transform at least 55 wt % of the nickel powder with the FCC crystal structure to nickel powder with a hexagonal close packed (HCP) crystal structure.

2. The method of claim 1, wherein the nickel precursor compound is selected from the group consisting of nickel acetate, nickel sulfate, nickel chloride, and mixtures thereof.

3. The method of claim 1, wherein the polyol is selected from the group consisting of ethyleneglycol, diethyleneglycol, triethyleneglycol, tetraethyleneglycol, propanediol-1,2, propanediol-1,3, dipropyleneglycol, butanediol-1,2, butanediol-1,3, butanediol-1,4, butanediol-2,3, and mixtures thereof.

4. The method of claim 1, wherein the mixture of step (a) further comprises an organic base, an inorganic base, or a mixture thereof.

5. The method of claim 4, wherein the base is an organic base and is selected from the group consisting of tetramethylammonium hydroxide, tetraethyiammonium hydroxide, tetrabutylammonium hydroxide, tetrapropylammonium hydroxide, benzyltrimethylammonium hydroxide, dimethyldiethylammonium hydroxide, ethyltrimethylammonium hydroxide, tetrabutylphosphonium hydroxide, trimethylamine, diethylamine, ethanolamine, and mixtures thereof.

6. The method of claim 1, wherein the mixture of step (a) further comprises a nucleation agent.

7. The method of claim 1, wherein step (a) is carried out at a temperature range of 45 to 350° C.

8. The method of claim 1, wherein step (b) is carried out at a temperature range of 150 to 380° C.

9. The method of claim 1, wherein step (b) is carried out at a temperature range of the boiling point of the polyol ±5° C.

10. The method of claim 1, wherein step (b) is carried out at a temperature range so that the polyol boils.

11. The method of claim 1, wherein, in step (b), the heating is carried out for 24 hours.

12. The method of claim 1, wherein in step (b) there was 100 wt % transformation to the hexagonal close packed (HCP) crystal structure.

13. A method for preparing nickel powder having a reduced saturation magnetization comprising:

(a) heating a mixture comprising a nickel precursor compound, an organic base selected from the group consisting of tetramethylammonium hydroxide, tetraethylammonium hydroxide, tetrabutylammonium hydroxide, tetrapropylammonium hydroxide, benzyltrimethylammonium hydroxide, dimethyldiethylammonium hydroxide, ethyltrimethylammonium hydroxide, tetrabutylphosphonium hydroxide, trimethylamine, diethylamine, ethanolamine, and mixtures thereof, and a polyol to reduce the nickel precursor compound to metallic nickel powder with the face-centered cubic (FCC) crystal structure; and thereafter (b) heating the resultant mixture of step (a) to transform at least a portion of the nickel powder with the FCC crystal structure to nickel powder with a hexagonal close packed (HCP) crystal structure.

14. The method of claim 13, wherein the nickel precursor compound is selected from the group consisting of nickel acetate, nickel sulfate, nickel chloride, and mixtures thereof.

15. The method of claim 12, wherein the polyol is selected from the group consisting of ethyleneglycol, diethyleneglycol, triethyleneglycol, tetraethyleneglycol, propanediol-1,2, propanediol-1,3, dipropyleneglycol, butanediol-1,2, butanediol-1,3, butanediol-1,4, butanediol-2,3, and mixtures thereof.

16. The method of claim 13, wherein the mixture of step (a) further comprises a nucleation agent.

17. The method of claim 13, wherein step (a) is carried out at a temperature range of 45 to 350° C.

18. The method of claim 13, wherein step (b) is carried out at a temperature range of 150 to 380° C.

19. The method of claim 13, wherein step (b) is carried out at a temperature range of the boiling point of the polyol ±5° C.

20. The method of claim 13, wherein step (b) is carried out at a temperature range so that the polyol boils.

21. The method of ciaim 13, wherein, in step (b), the heating is carried out for 24 hours.

* * * * *